US006532989B1

(12) United States Patent
Kauss

(10) Patent No.: US 6,532,989 B1
(45) Date of Patent: Mar. 18, 2003

(54) HYDRAULIC DISTRIBUTOR

(75) Inventor: Wolfgang Kauss, Francheville (FR)

(73) Assignee: Mannesmann Rexroth S.A., Venissieux (FR)

( * ) Notice: Subject to any disclaimer, the term of this patent is extended or adjusted under 35 U.S.C. 154(b) by 0 days.

(21) Appl. No.: 09/857,586

(22) PCT Filed: Dec. 8, 1999

(86) PCT No.: PCT/FR99/03052

§ 371 (c)(1),
(2), (4) Date: Sep. 7, 2001

(87) PCT Pub. No.: WO00/34665

PCT Pub. Date: Jun. 15, 2000

(30) Foreign Application Priority Data

Dec. 9, 1998 (FR) ..... 98 15523

(51) Int. Cl.[7] ..... F15B 11/05; F15B 13/02

(52) U.S. Cl. ..... 137/596; 91/446; 91/518; 137/514.3; 137/596.13

(58) Field of Search ..... 91/446, 518; 137/596, 137/596.13, 514.3

(56) References Cited

U.S. PATENT DOCUMENTS 5,305,789 A * 4/1994 Rivolier ..... 91/446
5,791,142 A * 8/1998 Layne et al. ..... 91/446

* cited by examiner

*Primary Examiner*—Gerald A. Michalsky
(74) *Attorney, Agent, or Firm*—Martin Fleit; Paul D. Bianco; Fleit Kain Gibbons Gutman & Bongini

(57) ABSTRACT

A hydraulic distributor that has a regulating balance including a housing hollowed in the distributor body and containing coaxially a fixed central core. A tubular plunger is interposed sliding freely, coaxially, between the core and the housing and co-operates with a lateral orifice connected to a working orifice. The core and the plunger define between them an annular chamber. The plunger has a first radial annular surface subjected to the highest charge pressure (LS) and a second annular surface subjected to the pressure of the intake fluid. A central passage in the core constitutes a first orifice emerging at one end of the housing exposed to the highest charge pressure (LS). A second orifice emerges in the annular chamber and a third orifice is located opposite the other end of the housing and remains closed by the plunger as long as the charge pressure of the distributor is below the highest charge pressure (LS).

6 Claims, 2 Drawing Sheets

HYDRAULIC DISTRIBUTOR

BACKGROUND OF THE INVENTION

1. Field of the Invention

The present invention concerns improvements to hydraulic distributors.

2. Prior Art

By way of example, FIG. 1 of the attached drawings shows, in cross-section, a known embodiment of such a distributor as it appears in FIG. 1 of the document FR-A-2 689 575 in the name of the common assignee.

The distributor comprises a body 1 provided with an intake orifice P for pressurized fluid supplied by a hydraulic source (not shown). In the example illustrated, said orifice P has the form of a channel 2 passing transversely 1 through body 1 in the plane of the drawing and emerging on the two main faces of said body which serve as contact faces when several distributors are stacked side-by-side and one against the other. At least one orifice T (having the form of a channel passing transversely through the body 1 in the plane of the drawing and emerging on the two main faces of said body) serves to return the fluid to a tank (not shown). Two working orifices A, B are connectable to a hydraulic device or receiver (not shown). A distribution valve slide 4 is able to slide in a bore 5 passing longitudinally through body 1 and emerging on two opposed faces of the ends 6, 7 of the body. In the conventional manner, the body 1 and the valve slide 4 include passages and/or channels and/or grooves arranged to co-operate in order to establish and/or interrupt the connections between the different orifices P, A, B, T of the distributor body according to the axial position occupied by the valve slide in the bore. The specific arrangements of these passages and/or channels and/or grooves are determined by a person skilled in the art in relation to the desired functions of the distributor.

In addition, in this specific example, the body 1 also includes a further transverse channel 8 extending between the main faces of the body and combined with at least one pressure selector allowing to be transmitted, in a channel 18 situated downstream of the distributor valve slide 4, the higher ("load sensing" or LS pressure) of the two pressures constituted respectively by the pressure in said channel upstream of the distributor and a working pressure of the distributor.

The channel 2 connected to the intake orifice P emerges in the bore 5 of the body in an intake chamber 10 of said body, close to which another chamber 11 communicates, via a passage 12, with a housing 13 in which a plunger 14 is mounted freely sliding and forming a fluid-tight seal. Passage 12 emerges into housing 13 at one end of the latter, here the lower end (corresponding to one end face of plunger 14, here its lower end), while at its opposite end (here its upper end) housing 13 opens into a cavity 15 in which the head 16 of plunger 14 can move. Head 16, wider in relation to the body of the plunger, can rest on a shoulder formed at the opening of housing 13 into cavity 15 to retain the plunger 14. A spring 17 is provided in cavity 15 to press plunger 14 against said shoulder so as to fix its position in the absence of pressure. The above-mentioned channel 8 emerges in cavity 15 in such a way that the pressure prevailing in channel 8 is also present in cavity 15 and is therefore exerted on the corresponding end of plunger 14 (here its upper end).

In addition, plunger 14 includes an axial channel 18 emerging, on one side, in its end face opposite passage 12 and, on the other, in a diametrical channel 19 passing through plunger 14 and so arranged as to be closed by the wall of housing 13 when plunger 14 is in the rest position determined by spring 17 (shown in FIG. 1) or in a not fully raised position. A part 28 of axial channel 18 is formed as a restriction or nozzle.

The portion of valve slide 4 which extends, in the neutral position, between chambers 10 and 11, isolating them from each other, is provided with progressive notches 20 intended to ensure a controlled flow of hydraulic fluid in the appropriate direction when the valve slide is displaced in one direction of the other. Two conduits 21 extend from above-mentioned housing 13 in two approximately diametrically opposite directions, in one or both of which conduits a non-return valve 22 is arranged, the two conduits 21 emerging in two respective chambers 23 in bore 5.

In the proximity of chambers 23 two respective distribution chambers 24 of bore 5 are connected by conduits 25 to the respective working orifices or outlet orifices A and B of the distributor.

Finally, beyond distribution chambers 24, two return chambers 26 of bore 5 are connected respectively by conduits 27 to return channel 3 emerging into the return orifice T.

The operation of the distributor just described is explained in detail in document FR 2 689 575 already cited, to which reference may be made.

Although a distributor arranged as just described is satisfactory with regard to its general principle of construction, it nevertheless has a disadvantage in certain operating conditions. Such a distributor is intended not to be used alone but in association with several other distributors of the same type to form a multiple hydraulic distribution device. The distributors are then preferably stacked in a fluid-tight manner one against the other by their main or large faces so that the respective conduits P, T and LS (channels 8) all communicate with each other and form conduits passing from one side of the stack to the other to enable the assembly to operate as a multiple distribution device.

When, in such a multiple distribution device, several sections (single distributors) are actuated simultaneously for large movements of the hydraulic receivers supplied, instabilities due to the inadequate damping of the movements of the balances occur. In other words, because of the simultaneous movements of the balances in the respective distributors, the balances react on each other through the intermediary of channel LS and it is difficult to establish equilibrium in pressure LS.

SUMMARY OF THE INVENTION

The objective of the invention is therefore to provide an improved arrangement of the distributor which avoids this disadvantage and which leads to rapid stabilization of pressure LS in the case of multiple actuation.

To this end, a hydraulic distributor comprises a regulating balance able to perform a function of detecting the highest charge pressure, an anti-saturation function and a delivery-dividing function independent of the charge, this balance including a housing hollowed in the distributor body and in which a plunger is movable, this housing comprising:

- a first end able to receive selectively the pressurized hydraulic fluid delivered by a hydraulic source,
- a second end in communication with a channel conveying the highest charge pressure, and
- a lateral orifice communicating selectively with a working orifice of the distributor, said plunger including a passage provided with a restriction and opening, on one side, towards said first end of the housing and, on the other, opening laterally so as to emerge in the above-mentioned second end of the housing when the plunger occupies a position determined by the excess of said intake pressure reduced by the pressure drop caused by the restriction, as compared to the highest charge pressure prevailing in the above-mentioned second end of the housing, said plunger being arranged to uncover the lateral orifice of the housing and to connect the latter with the first end of the housing in proportion to the pressure differential between the intake pressure and the highest charge pressure prevailing in the second end of the housing.

The hydraulic distributor, arranged in accordance with the invention, is characterized in that the balance comprises:

a fixed central core extending in the housing and coaxially with it;

the tubular plunger interposed sliding freely, coaxially, between the core and the housing, said plunger having a length less than that of the core and being so configured externally as to cover or uncover the lateral orifice more or less according to its position, the core and the plunger being mutually configured to define between them an annular chamber having a first radially extending annular surface defined by the plunger, a second radially extending annular surface located on the plunger and facing towards the first surface and being adapted to be subjected to the pressure of the intake fluid, a central passage formed in the core and including a first orifice emerging in the above-mentioned second end of the housing in which the highest charge pressure prevails, a second orifice emerging in the above-mentioned annular chamber between the core and the plunger in such a way that the pressure is exerted on the annular surface of said chamber, and a third orifice located opposite the above-mentioned first end of the housing and being closed by the plunger as long as the charge pressure of the distributor does not constitute the highest charge pressure.

The balance arrangement which has just been described retains the basic provisions and functions of the balance used in the known distributor shown in FIG. 1. The fixed central core incorporates the nozzle of the linking conduit between the first end of the housing receiving the intake fluid and the second end of the housing under the pressure LS; the tubular plunger, sliding around the central core, permits the generation of the pressure differential $\Delta p$ between the pressure of the fluid coming from the hydraulic source and the charge pressure delivered to the lateral orifice of the housing, then to the working orifice.

Furthermore, the second orifice of the core passage is preferably provided with a restriction so that movement of the plunger is restricted hydraulically: in this way damping means are provided (chamber with variable volume defined between the tubular plunger and the central core and connected to the central passage by said second nozzle) which control the movement of the tubular plunger and avoid vibration of the latter.

In an advantageous embodiment, the core includes a widened body in the area of the second end of the housing and a narrowed portion in the area of the first end of the housing; the tubular plunger includes a portion of large diameter surrounding the widened body of the core and a portion of small diameter surrounding the narrowed portion of the core; and the length of the widened body of the core is less than that of the large-diameter portion of the plunger so as to define the above-mentioned annular chamber between the core and the plunger.

Interestingly, the restriction of the balance is arranged in the third above-mentioned orifice of the core passage.

In an example of a structurally simple embodiment, the housing is formed by a bore opening on one face of the distributor body and this bore is closed by a fluid-tight plug which blocks the core in the housing.

Finally, to reduce machining of the parts as much as possible the central core can be made of unfinished cast iron or bronze and the tubular plunger can be of steel which is precision-finished on its inner face.

BRIEF DESCRIPTION OF THE DRAWINGS

The invention will be better understood from a reading of the following detailed description of a preferred embodiment of a hydraulic distributor arranged according to the invention.

In FIGS. 2A and 2B the same reference numbers are retained to designate elements identical to those in FIG. 1.

The balance, referred to as a whole by reference number 29, is constituted by two parts enclosed in housing 13, namely a fixed central core 30 and a tubular plunger or piston 31 which is inserted freely sliding between fixed core 30 and housing 13.

Figure 1:
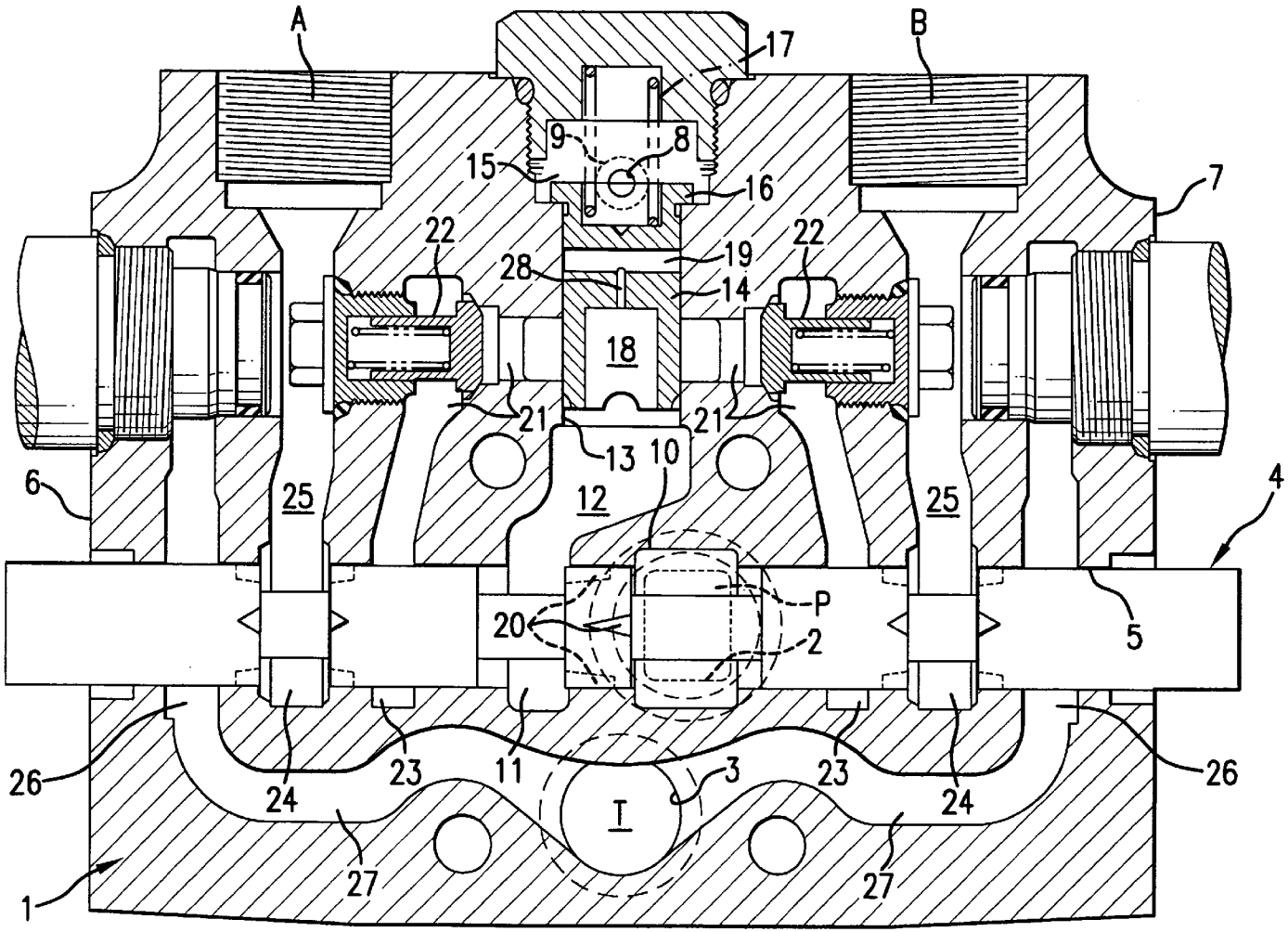
FIG.1 PRIOR ART
FIG. 1 is a view in cross-section of a known hydraulic distributor.
Figure 2B:
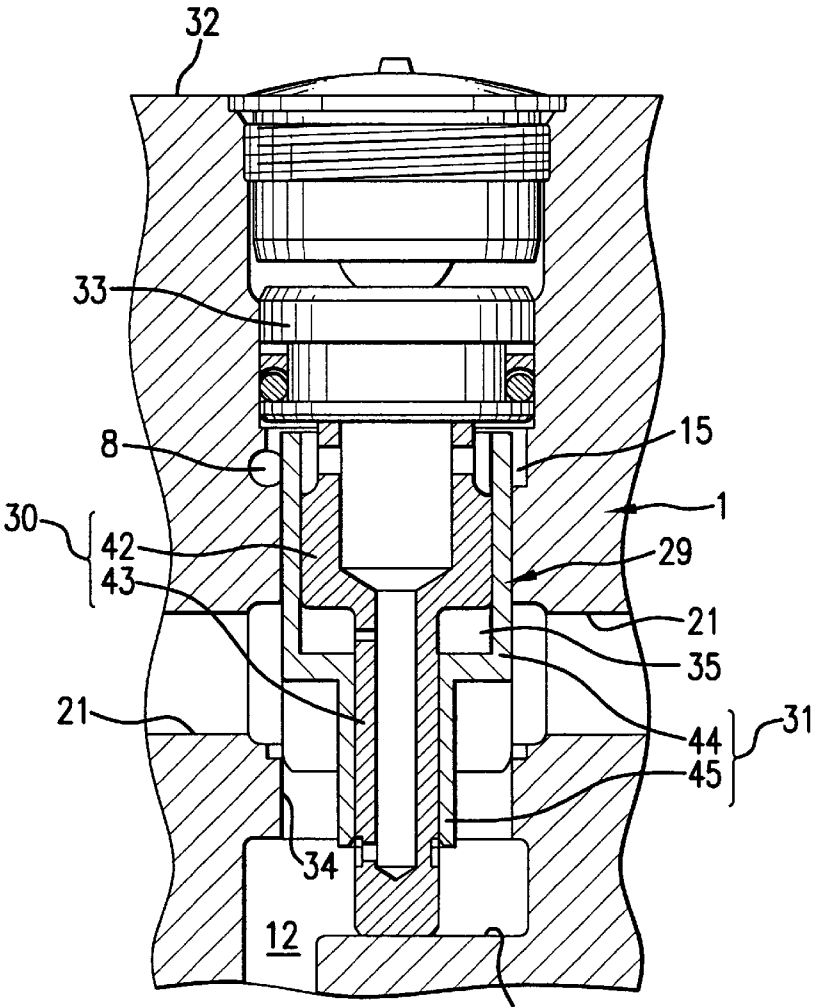
FIGS. 2A and 2B are partial views of the distributor shown in FIG. 1, as modified to show the regulating balance arranged according to the invention, the view being in cross-section and showing two different operating positions.
Figure 2A:
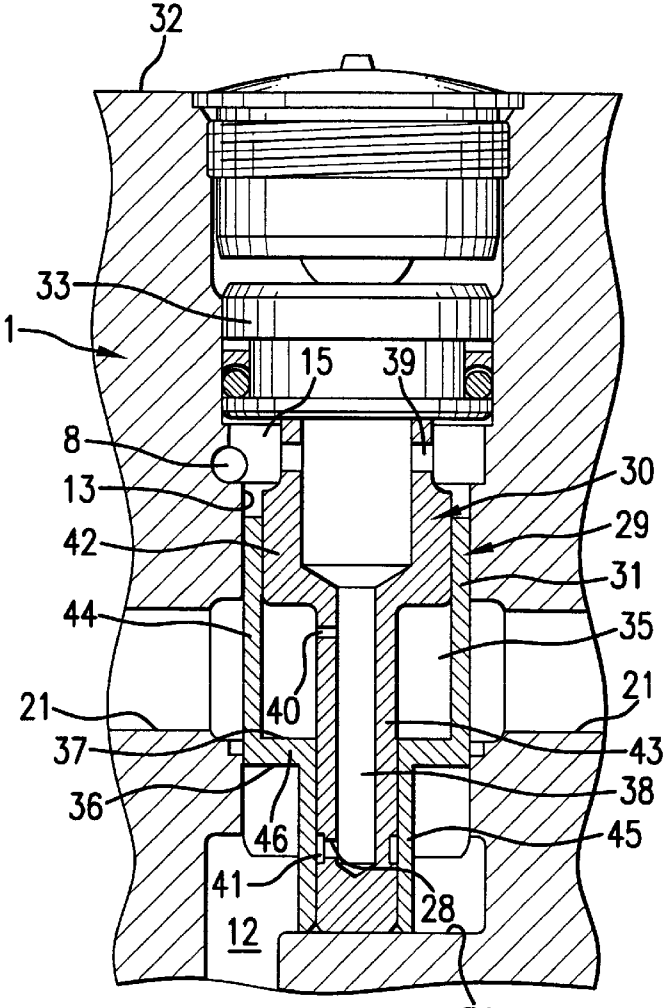

Fixed core 30 extends the full length of housing 13 and coaxially with it. In the example of a structurally simple embodiment illustrated in FIGS. 2A–2B, the core 30 which may be made of unfinished cast iron or bronze, also extends across the lower chamber 12. Housing 13 opens on the upper wall 32 of the distributor and a fluid-tight plug 33 closes this orifice while pressing the core against the opposite face 34 of chamber 12, immobilizing the core.

The length of tubular plunger 31, which may be made of steel with its inner face precision finished, is less than that of the core and is externally configured so as to cover (FIG. 2A) or uncover, more or less (FIG. 2B) according to the position occupied by the plunger, the lateral orifice through which conduits 21 emerge in housing 13.

In addition, central core 30 and tubular plunger 31 are mutually configured to define between them a radially extending annular chamber 35, the volume of which varies according to the position of the plunger.

Plunger 31 has a radially extending annular surface 36 able to be subjected to pressure P of the intake fluid. Likewise, the plunger has a radially extending annular surface 37 facing away from said surface 36 and able to be subjected to pressure LS prevailing in conduit LS 8 and in the upper chamber 15; this annular surface 37 forms part of one of the walls defining abovementioned annular chamber at 35 located between the core and the plunger. Finally, to enable appropriate distribution of pressures, core 30 includes a central passage, here an axial passage, 38. At or near its upper end, this passage 38 communicates via a radial channel 39 with upper chamber 15 in which pressure LS prevails. A second radial channel 40 connects the axial passage with annular chamber 35 so that pressure LS prevailing in axial passage 38 is applied, via radial channel 39, to the abovementioned annular surface 37. Finally, a third radial channel 41 is located near the lower end of core 30; this third radial channel 41 has the form of a restriction or nozzle 28 or incorporates such a nozzle, and remains closed by plunger 31 as long as the charge pressure of the distributor does not constitute the highest charge pressure, that is, remains lower than the pressure LS prevailing in upper chamber 15.

To damp the movement of plunger 31 and thus avoid vibration of it in the case of simultaneous multiple actuation, the flow of fluid under pressure LS into or out of annular chamber 35 is restricted by forming the second radial channel 40 as a nozzle or by incorporating a nozzle in said channel.

To obtain a simple structural arrangement, with a small number of components not requiring complex fabrication, core 30 is provided with a widened body 42 in its upper part and a smaller-diameter part forming a stem 43 in its lower part. In the same way, tubular plunger 31 includes an upper part 44 of large diameter surrounding the widened body 42 of the core and interposed between the latter and the wall of housing 13, and a lower part 45 of smaller diameter surrounding the stem-shaped part 43 of the core. In addition, the length of the widened body 42 of core 30 is less than that of the larger-diameter upper part 44 of plunger 31, so that the above-mentioned annular chamber 35 is defined between the opposed portions of the stem-shaped part 43 of the core and the larger-diameter part 44 of the plunger.

Finally, the upper part 44 of larger diameter and the smaller-diameter lower part 45 of the plunger are connected together by a radially extending annular wall 46, the two faces of which, respectively an upper face (inside chamber 35) and a lower face (facing towards chamber 12), constitute the two above-mentioned surfaces 37 subjected to pressure LS and 36 subjected to intake pressure P, respectively.

Because of the provisions of the invention, not only is the new arrangement of the regulating balance able to provide the functions of detecting the highest charge pressure, of anti-saturation, and of dividing the fluid supply independently of the charge, in the same way as the previous balance of the distributor described in document FR-A-2 689 575, but in addition the regulating balance arranged according to the invention is protected against oscillations liable to be generated in the case of simultaneous multiple actuation in a multiple distribution device. In this way the operating conditions of the hydraulic receiver actuated by the distributor are considerably improved and the working conditions of the user are significantly simplified, since the user no longer needs to take care to avoid actuating several hydraulic receivers simultaneously.

In addition, it will be noted that the technical arrangements used to this end remain simple, that the number of components is reduced and that their fabrication requires only machining procedures in general use.

Finally, it will also be noted that the regulating balance according to the invention can be installed in a distributor body in place of a regulating balance of the previous type.

Although the invention has been shown and described in terms of a specific embodiment, changes will be evident to those skilled in the art that do not depart from the teachings of the invention. Such changes are deemed to fall within the purview of the invention as claimed.

What is claimed is:

1. Hydraulic distributor comprising a regulating balance able to perform a function of detecting a highest charge pressures an anti-saturation function and a delivery-dividing function independent of a charge, this balance comprising a housing hollowed in a distributor body in which a plunger is movable, the housing comprising:

a first end able to receive selectively pressurized hydraulic fluid (P) delivered by a hydraulic source, a second end in communication with a channel conveying the highest charge pressure (LS), and a lateral orifice communicating selectively with a working orifice (A, B) of the distributor, said plunger including a passage provided with a restriction which opens, on one side, towards said first end of the housing and, on the other side, opens laterally so as to emerge in the above-mentioned second end of the housing when the plunger occupies a position determined by the excess of said intake pressure (P) reduced by the pressure drop ($\Delta p$) caused by the restriction, as compared to the highest charge pressure (LS) prevailing in the said second end of the housing, said plunger being arranged to uncover the lateral orifice of the housing and to connect the latter with the first end of the housing in proportion to the pressure differential ($\Delta p$) between the intake pressure and the highest charge pressure prevailing in the second end of the housing, characterized in that the balance includes;

a fixed central core extending inside the housing coaxially with it, a tubular plunger interposed freely sliding, coaxially, between the core and the housing, said plunger having a length less than that of core and being externally configured to cover or uncover the lateral orifice of the housing more or less according to its position, the core and the plunger being mutually configured to define between them an annular chamber having a first radially-extending annular surface defined on the plunger, a second radially-extending annular surface located on the plunger and facing away from the first surface and being able to be subjected to the pressure (P) of the intake fluid, and a central passage formed in the core and including a first orifice emerging in the second end of the housing in which the higher charge pressure (LS) prevails, a second orifice emerging in the annular chamber between the core and the plunger so that the pressure (LS) is exerted on the annular surface of said annular chamber, and a third orifice located opposite the first end of the housing and closed by the plunger as long as the charge pressure of the distributor does not constitute the highest charge pressure.

2. Hydraulic distributor according to claim 1, characterized in that the second orifice of the passage of the core is provided with a restriction so that the movement of the plunger is hydraulically damped.

3. Hydraulic distributor according to claim 1, characterized in that the core includes a widened body in the area of the second end of the housing and a narrowed portion in the area of the first end of the housing, and in that the tubular plunger includes a portion of large diameter surrounding the widened body of the core and a portion of small diameter surrounding the narrowed portion of the core, the length of the widened body of the core being less than that of the large-diameter portion of the plunger so as to define the above-mentioned annular chamber between the core and the plunger.

4. Hydraulic distributor according to claim 1, characterized in that the restriction of the balance is arranged in the above-mentioned third orifice of the passage of the core.

5. Hydraulic distributor according to claim 1, characterized in that the housing is constituted by a bore opening on one face of the distributor body and in that this bore is closed by a fluid-tight plug which blocks the core in the housing.

6. Hydraulic distributor according to claim 1, characterized in that the central core is made of unfinished cast iron or bronze and in that the tubular plunger is made of steel and is precision-finished on its internal face.

* * * * *